US007553120B2

(12) United States Patent
Veneziani

(10) Patent No.: US 7,553,120 B2
(45) Date of Patent: Jun. 30, 2009

(54) HYDRAULIC CONTROL UNIT FOR THE ARMS OF A GRIP AND GRIP INCLUDING SAID HYDRAULIC UNIT

(75) Inventor: Luciano Veneziani, Gossolengo PC (IT)

(73) Assignee: Auramo Oy, Vantaa (FI)

( * ) Notice: Subject to any disclaimer, the term of this patent is extended or adjusted under 35 U.S.C. 154(b) by 374 days.

(21) Appl. No.: 11/426,402

(22) Filed: Jun. 26, 2006

(65) Prior Publication Data

US 2007/0017364 A1 Jan. 25, 2007

(30) Foreign Application Priority Data

Jul. 4, 2005 (IT) ..... MI2005A1256

(51) Int. Cl.
*B66F 9/18* (2006.01)

(52) U.S. Cl. ..... 414/621; 414/911; 91/514; 91/515; 137/101; 294/88

(58) Field of Classification Search ..... 91/514, 91/515; 137/118.02, 118.04, 118.05, 101, 137/512.1, 512.15; 414/621, 911; 901/22
See application file for complete search history.

(56) References Cited

U.S. PATENT DOCUMENTS 2,374,630 A * 4/1945 Tucker ..... 60/426
2,460,774 A * 2/1949 Trautman ..... 137/101
3,760,688 A * 9/1973 Drummer ..... 91/515
4,325,400 A * 4/1982 Wynne ..... 137/101
4,505,339 A * 3/1985 Kramer et al. ..... 172/812
4,682,931 A * 7/1987 House ..... 414/623
5,984,617 A * 11/1999 Seaberg ..... 414/623
6,439,826 B1 * 8/2002 Jordan et al. ..... 414/636
2005/0063811 A1 * 3/2005 Seaberg ..... 414/621
2006/0073001 A1 * 4/2006 Chase ..... 414/621

* cited by examiner

*Primary Examiner*—Saúl J Rodriguez
*Assistant Examiner*—Jonathan Snelting
(74) *Attorney, Agent, or Firm*—McGlew and Tuttle, P.C.

(57) ABSTRACT

A hydraulic grip-control unit provided with at least two gripping arms driven hydraulically to seize loads while cooperating with a striker arm of the grip with the control unit in use being connected hydraulically between a hydraulic fluid source under pressure and hydraulic cylinders each of which drives a gripping arm to form a closed supply circuit in which the source feeds fluid to the cylinders connected hydraulically in parallel and with the unit including a flow divider connected along said supply circuit between said source and said cylinders to apportion the flow of the circuit between the cylinders in parallel. The divider has a nominal flow lower than the nominal flow of the control unit with the control unit also including a by-pass circuit connected in parallel to said divider, which can take on an operative configuration in which it can be traveled by fluid and a nonoperative configuration in which it cannot be traveled by the fluid with the control unit including automatic by-pass circuit piloting means designed to pilot it in the non-operative configuration when the flow required by the supply circuit is substantially lower than the nominal flow of the divider and in the operative configuration when said required flow is substantially higher than that of the divider.

20 Claims, 3 Drawing Sheets

HYDRAULIC CONTROL UNIT FOR THE ARMS OF A GRIP AND GRIP INCLUDING SAID HYDRAULIC UNIT

BACKGROUND OF THE INVENTION

1. Field of the Invention

This invention relates to an innovative hydraulic grip control unit provided with independent gripping arms driven hydraulically to seize a load. More generally, this invention relates to a grip including said innovative hydraulic control unit.

2. State of the Prior Art

The technique of realizing grips provided with two independent gripping arms driven hydraulically to seize a load while cooperating with an appropriate striker arm is known. Each gripping arm is driven by its own hydraulic cylinder. The two driving cylinders are fed in parallel by a hydraulic control unit which receives oil from a hydraulic pump and distributes it to the cylinders while controlling the force of the grip on the load.

At the point of the hydraulic circuit where the oil supply duct branches into the two branches of the cylinders, a flow divider intended to keep the apportionment of the fluid balanced between the two cylinders is inserted to obtain synchronism in the movement of the two gripping arms.

Said hydraulic units however do not ensure synchronism of the arms under all operating conditions of the grip. Indeed, when the system works with oil flows considerably lower than the nominal flow of the system the apportionment error committed by the divider becomes considerable and causes a lack of sync of the movement of the arms and especially during cylinder re-entry.

In addition, the use of a divider with high nominal flow equal to the nominal flow of the system considerably affects the total cost of the unit.

The general purpose of this invention is to remedy the above-mentioned shortcomings by making available a hydraulic grip control unit provided with distinct gripping arms capable of ensuring synchronism in the movement of the arms in all grip operating conditions.

Another purpose of this invention is to make available a control unit which would be economical and have flexible operation.

SUMMARY OF THE INVENTION

In view of this purpose it was sought to provide in accordance with this invention a hydraulic grip-control unit provided with at least two gripping arms driven hydraulically to seize loads while cooperating with a striker arm of the grip with the control unit in use being connected hydraulically between a source of hydraulic fluid under pressure and hydraulic cylinders each of which drives a gripping arm to form a closed supply circuit in which the source supplies fluid to the cylinders connected hydraulically in parallel and with the unit including a flow divider connected along said supply circuit between said source and said cylinders to apportion the flow of the circuit between the cylinders in parallel and characterized in that said divider has a nominal flow lower than the nominal flow of the control unit with the control unit also including a by-pass circuit connected in parallel with said divider which can take on an operative configuration in which it can be traveled by fluid and a non-operative configuration in which it cannot be traveled by fluid with the control unit including automatic by-pass circuit piloting means designed to pilot it in the non-operative configuration when the flow required by the supply circuit is substantially lower than the nominal flow of the divider and in the operative configuration when said required flow is substantially higher than that of the divider.

BRIEF DESCRIPTION OF THE DRAWINGS

To clarify the explanation of the innovative principles of this invention and its advantages compared with the prior art there is described below with the aid of the annexed drawings a possible embodiment thereof by way of non-limiting example applying said principles. In the drawings.

DETAILED DESCRIPTION OF THE INVENTION

Figure 1:
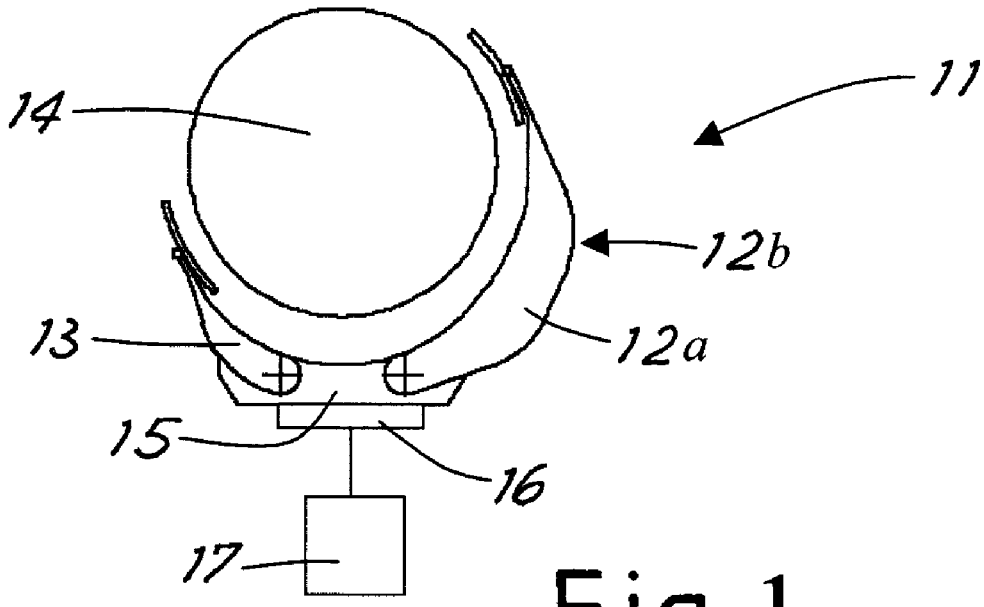
FIG. 1 shows a top view of the grip including a hydraulic control unit in accordance with this invention.

With reference to the figures, FIG. 1 shows a top view of a grip 11 in position to seize a load 14 (for example, one or more coils). The grip 11 includes a body 15 on which are hinged a striker arm 13 and two distinct gripping arms 12*a* and 12*b* arranged vertically one above the other. The arms are driven hydraulically by appropriate hydraulic cylinders (not shown in FIG. 1) to seize the load 14 rotating around the hinging to the body 15 and cooperating with the arm 13.

As shown diagrammatically in FIG. 1, on the grip 11 is integrated a hydraulic control unit 16 which receives work fluid (typically oil) from a source of fluid under pressure 17 and distributes it to the hydraulic driving cylinders.

Figure 2:
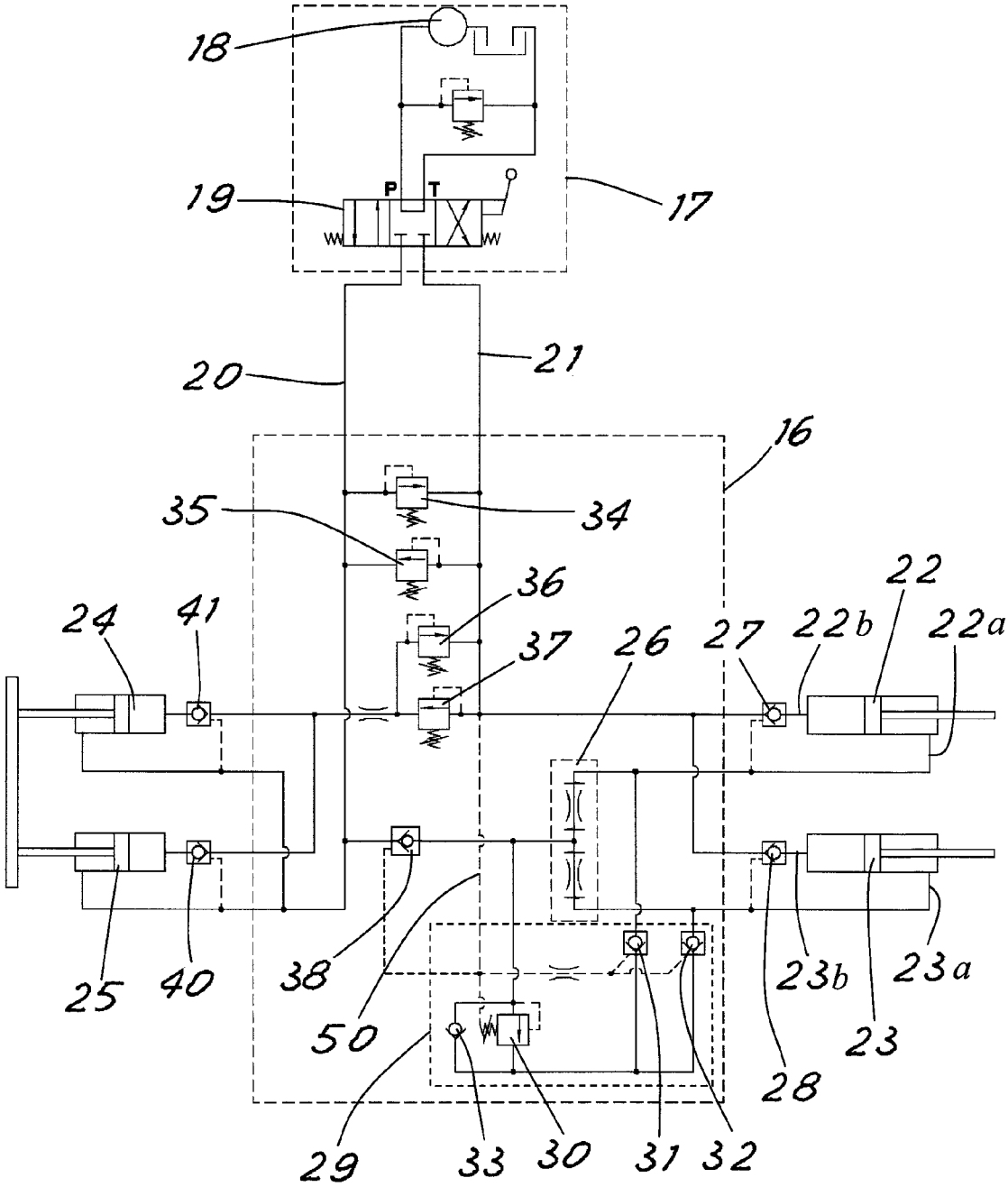
FIG. 2 shows the diagram of the grip hydraulic circuit.

FIG. 2 shows the diagram of the hydraulic circuit supplying the cylinders 22, 23, 24 and 25 which operate the arms of the grip 11.

In particular, the cylinders 22 and 23 are each associated with one of the two gripping arms 12*a* and 12*b* while the cylinders 24 and 25 are connected to the striker arm 13.

The control unit 16 is connected between the pressurized fluid source 17 and the cylinders 22 and 23 so as to form a closed supply circuit in which the source 17 supplies oil to the cylinders 22 and 23 placed between them in parallel.

The source 17 includes an oil pump 18 fitted with a maximum valve in parallel in accordance with known stratagems in the field and a slide-valve distributor 19 for sorting the pumped flow according to need on the branch 21 or on the delivery branch 20. When the oil is pumped on the branch 21, the arms are closing to seize a load while when oil is pumped on the branch 20 the grip 11 is opening with re-entry of the hydraulic cylinders 22, 23, 24 and 25.

The cylinders 22, 23 have the 'delivery side during gripping' 22*b*, 23*b* connected hydraulically to branch 21 while 'the discharge side gripping' 22*a* and 23*a* of the two cylinders is connected to the flow divider 26 which is arranged along the supply circuit of the two cylinders 22, 23 to apportion (or unite) the oil flow between the two parallel branches of the two cylinders. The flow divider 26 is a device known in itself in technology and has the function of ensuring synchronism of movement of the two cylinders 22, 23 while keeping a certain proportion between the flows running in the cylinders.

In accordance with known stratagems, the gripping force of the grip is controlled with the maximum valve 35 placed in parallel with the source of fluid under pressure 17. The maximum valve 34 controls the maximum overpressure which can exist on the branch 20 relative to the branch 21 during re-entry of the cylinders.

On the 'delivery side during gripping' 22*b*, 23*b* of the two cylinders there is inserted a check valve, respectively 27 and 28, piloted as a function of the pressure on the opposite side of the respective cylinder so as to allow re-entry of the cylinders only if the discharge side during gripping 22*a*, 23*a* is taken to a certain pressure.

In accordance with this invention the flow divider 26 is sized with a nominal flow less than the nominal flow of the rest of the hydraulic circuit of the grip. For example, the flow of the divider 26 could be one-fourth less than the flow of the hydraulic unit 16 and advantageously between 6% and 15% of the nominal flow of the circuit. Quantitatively, the nominal flow of the divider could be, for example, between 6 and 15 l/min with nominal flow of the hydraulic unit equal to 100 l/min.

The divider 26, having low nominal flow, allows having limited flow apportionment errors at low flows to ensure simultaneous piloting of the check valves 27, 28 during opening of the grip and allowing keeping synchronism between the two cylinders 22 and 23.

Again in accordance with this invention the hydraulic unit 16 has a by-pass circuit 29 placed in parallel with the divider 26.

The by-pass circuit 29 can take on command an operative configuration in which it can be run through by the oil so as to by-pass the divider 16 and a non-operative configuration in which it cannot be run through by the oil.

The by-pass circuit 29 is controlled by automatic piloting means as a function of hydraulic parameters of the supply circuit of the cylinders 22 and 23 so as to start driving when the required oil flow exceeds nominal of the divider 26 and remain inactive for lower required flows. By 'required flow' is meant the flow made available to the hydraulic circuit by the operator acting on the maximum valves 34 and 35.

In the realization shown in FIG. 1 the circuit 29 includes a sequence valve 30 through which it is connected to the supply circuit of the cylinders immediately upstream of the divider 26. Advantageously, downstream of the divider 26 the by-pass circuit is connected through two piloted check valves 31, 32 respectively to the discharge side during gripping 22*a* of the cylinder 22 and to the discharge side during gripping 23*a* of the cylinder 23. In the realization of FIG. 2 the outlet of the sequence valve 30 is connected directly to the valves 31, 32 with 3-way connection.

The opening of the sequence valve 30 is controlled as a function of the pressure upstream of the divider 26 whose level is linked to the flow required during re-entry by setting the maximum valve 34.

Opening of the check valves 31 and 32 is controlled through control connection 50 as a function of the pressure on the delivery side during gripping of the cylinders 22 and 23 whose level is tied to the flow required during gripping by acting on the maximum valve 35.

When during re-entry of the arms 22, 23 a greater than nominal flow of the divider 26 is required a counter pressure is created upstream of the divider 26 commanding opening of the sequence valve 30 causing the flow in excess over nominal of the divider to reach the cylinders through the by-pass 29. In this situation, synchronism is kept anyway since the high flows in play allow correct and simultaneous piloting of the check valves 27 and 28.

When during gripping on the other hand, with oil pumped on the branch 21 and higher than nominal flow of the divider 26 is required, a pressure is created upstream of the cylinders 22 and 23 which causes opening of the check valves 31 and 32 driven by the connection 50. In this manner the by-pass circuit begins to operate by causing the oil discharged by the cylinders during gripping to run to the branch 20 through the check valve 33 placed in parallel with the sequence valve 30 (which allows flow only in the supply direction of the by-pass.

Note that the piloted valves which drive the by-pass can be of any type known in technology even with piloting types different from those described. The valves can indeed be piloted as a function of any hydraulic parameter of the supply circuit which is linked to the total required flow so that the by-pass begins to operate for flows exceeding nominal of the divider.

Figure 3:
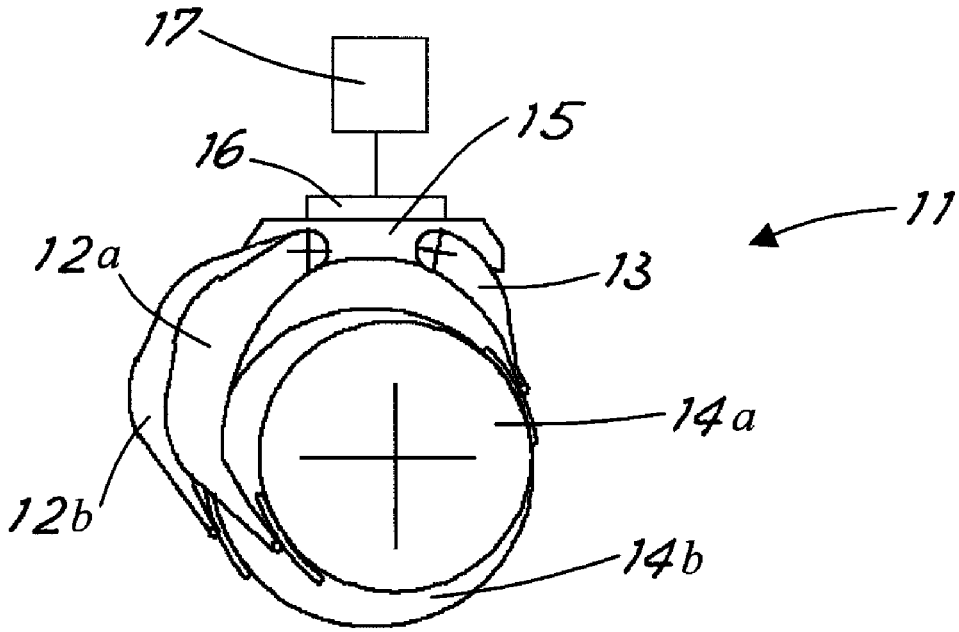
FIG. 3 shows a top view of a grip realized in accordance with this invention during seizure of two coils having different diameters.

The grip 11 allows gripping of two loads having different dimensions as shown in FIG. 3 where the two gripping arms 12*a* and 12*b* seize two coils 14*a*, 14*b*having different diameters.

In this case, during gripping, the cylinders 22 and 23 are moved synchronously until one of the two gripping arms 12*a*, 12*b* makes contact with the load. At this point, one of the two cylinder discharge branches supplies no more oil to the divider 26. This situation unbalances the operation of the divider 26 so much that a pressure increase is created upstream of the cylinders commanding opening of the check valves 31 and 32. This allows the cylinder of the arm not yet having seized to continue discharging until seizure is realized as shown in FIG. 3.

Cylinders 24 and 25 which drive the striker arm are connected in parallel between the branches 20 and 21 in accordance with the known art with two maximum valves 36 and 37 arranged as shown on the discharge side during re-entry of the cylinders 24, 25.

Similarly to cylinders 22 and 23, with each cylinder 24 and 25 a piloted check valve 40, 41 is associated so as to exclude re-entry of the cylinders when fluid is not pumped on the delivery branch during re-entry 20.

In the hydraulic circuit of the unit there could also be a check valve 38 (shown in FIG. 2) to ensure correct position of the arms 12*a*, 12*b* when the grip works in vertical position. Indeed, under this condition the distributor 19 does not ensure checking so that the valve 38 becomes necessary to avoid the weight of the arms causing the cylinders 22 and 23 to slip off.

Figure 4:
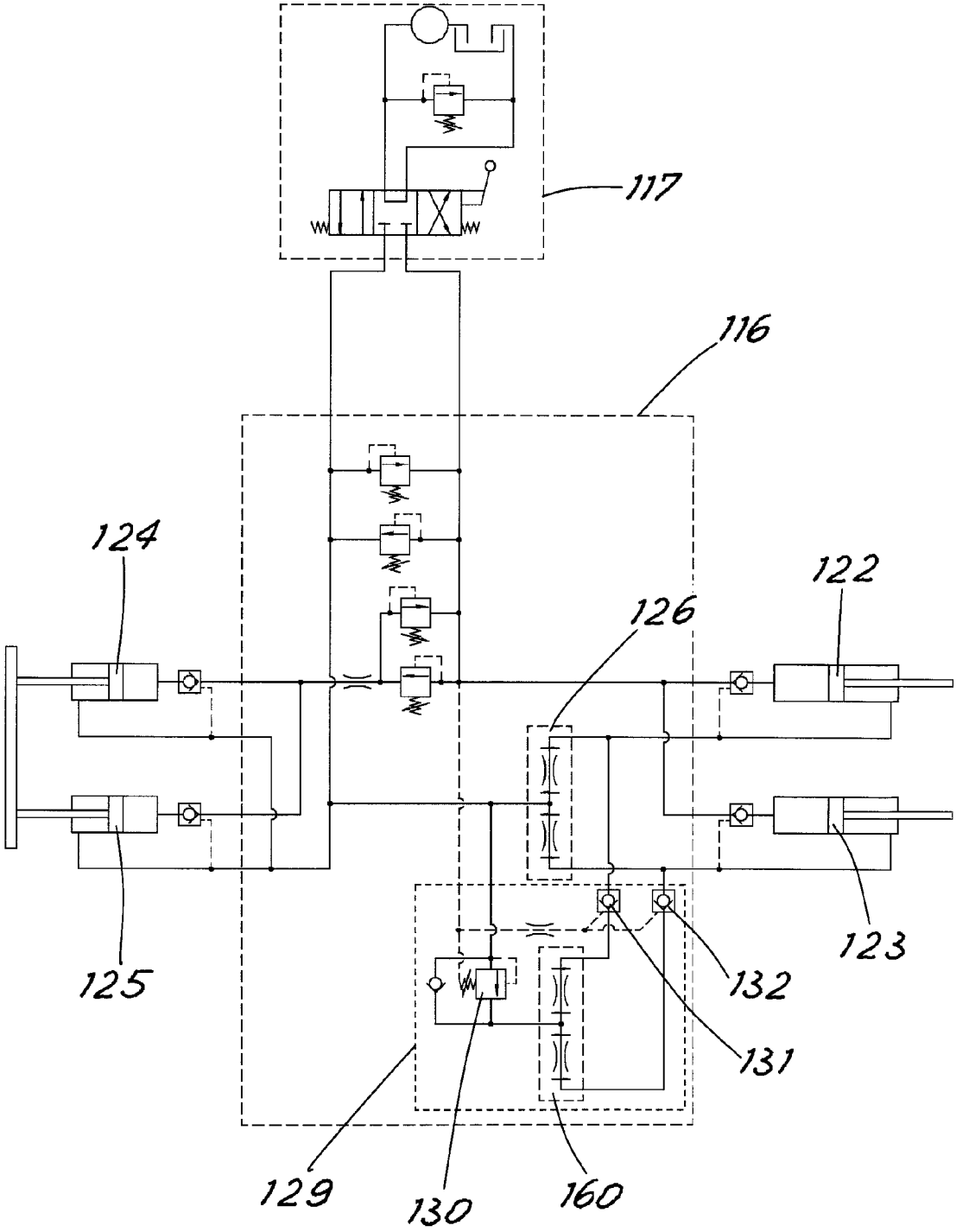
FIG. 4 shows the diagram of an alternative realization of the hydraulic unit in accordance with this invention.

FIG. 4 shows an alternative realization of the control unit 116 of the driving cylinders 122, 123, 124 and 125 of the grip arms.

Similarly to the above realization, the hydraulic unit 116 is connected between the source of fluid under pressure 117 and the cylinders 122, 123 driving the gripping arms so as to form a supply circuit in which the source 117 supplies oil to the cylinders 122, 123 placed in parallel.

The flow divider 126 is arranged along the supply circuit between the cylinders 122, 123 and the source 117 to apportion the supply flow between the two branches in parallel while keeping a certain proportion between the two apportioned flows. The divider 126 has nominal flow less than the nominal flow of the hydraulic unit 116.

The unit 116 includes a by-pass circuit 129 in parallel with the divider 126. The by-pass circuit 129 is fully like the circuit 29 described for the above realization with the only difference being that between the sequence valve 130 and the piloted check valves 131, 132 there is inserted a second flow divider 160 which apportions the flow to the two valves 131, 132 while keeping a certain predetermined proportion between the two apportioned flows. The divider 160 has nominal flow greater than the divider 126 and equal for example to the difference between the nominal flow of the unit 116 and the flow of the divider 126.

During re-entry of the cylinders and during gripping of a single load or loads of the same size (for example, two coils of the same diameter,) operation of the by-pass circuit is quite similar to that described above.

When, on the other hand, a low load intended to remain seized by only one of the two gripping arms is seized, the gripping arm not involved in the seizing does not close until the end of travel and remains always aligned with the gripping arm which acts on the load because the presence of the divider 160 on the by-pass circuit prevents having unbalanced flows on the two gripping cylinders even for high flows.

It is now clear that the preset purposes have been achieved.

A hydraulic control unit for the gripping arms of a grip allowing keeping the synchronism between the gripping arms in case of flows considerably lower than the nominal flow of the unit is made available.

In addition, an economical hydraulic control unit able to control the operation of the two gripping arms flexibly is made available.

Naturally the above description of an embodiment applying the innovative principles of this invention is given by way of non-limiting example of said principles within the scope of the exclusive right claimed here.

The grip could also include three independent gripping arms driven by three cylinders in parallel; in this case the flow divider would be provided with three paths for apportionment of the oil to the three cylinders.

In addition, the grip need not necessarily be of the type having rotatable gripping arms but could include gripping arms translatable in a straight horizontal direction.

What is claimed is:

1. A hydraulic grip control unit, comprising:

a hydraulic grip control device;

a striker arm;

a hydraulic fluid source under pressure;

hydraulic cylinders;

gripping arms driven hydraulically to seize loads while cooperating with said striker arm, said control device being connected hydraulically between said hydraulic fluid source under pressure and said hydraulic cylinders to form a closed supply circuit, each of said hydraulic cylinders driving one of said gripping arms, wherein said source feeds fluid to the cylinders, said cylinders being connected hydraulically in parallel, said control device including a flow divider connected along said supply circuit between said source and said cylinders such that said flow divider apportions the flow of the circuit between the cylinders in parallel, said flow divider having a nominal flow, said nominal flow of said flow divider being less than a nominal flow of the control device, said control device including a by-pass circuit connected in parallel to said flow divider, said by-pass circuit having an operative configuration and a non-operative configuration, said fluid flowing through said by-pass circuit and said flow divider in said operative configuration, said fluid not flowing through said by-pass circuit in said non-operative configuration, said control device including automatic by-pass circuit piloting means for switching said by-pass circuit to said non-operative configuration when the flow required by the supply circuit is substantially lower than the nominal flow of the flow divider and for switching said by-pass circuit to said operative configuration when said required flow is substantially greater than the nominal flow of the flow divider.

2. A hydraulic unit in accordance with claim 1, wherein only two said gripping arms are provided.

3. A hydraulic unit in accordance with claim 1, wherein said flow divider is connected upstream to the pressurized fluid source and said flow divider is connected downstream to the hydraulic cylinders on a discharge side of said hydraulic cylinders during gripping.

4. A hydraulic unit in accordance with claim 3, wherein said by-pass circuit is connected to the supply circuit upstream of the divider through a sequence valve controlled as a function of a pressure level upstream of the flow divider to supply the by-pass circuit when said pressure level exceeds a predetermined threshold.

5. A hydraulic unit in accordance with claim 3, wherein said by-pass circuit is connected to discharge sides of said cylinders during gripping of the cylinders via piloted check valves, each of said piloted check valves being associated with one of the cylinders and each of said piloted check valves being controlled as a function of a delivery side pressure during gripping of the cylinders to supply the by-pass circuit when said pressure level exceeds a predetermined threshold.

6. A hydraulic unit in accordance with claim 4, wherein said by-pass circuit is connected to discharge sides of said cylinders during gripping of the cylinders via piloted check valves, each of said piloted check valves being associated with one of the cylinders and each of said piloted check valves being controlled as a function of a delivery side pressure during gripping of the cylinders to supply the by-pass circuit when said delivery side pressure level exceeds a predetermined threshold, said by-pass circuit including a check valve connected in parallel with the sequence valve to allow during gripping discharge of the fluid from the cylinders when the by-pass circuit is in driving condition.

7. A hydraulic unit in accordance with claim 6, wherein said piloted check valves of the by-pass circuit are connected directly to an outlet of the sequence valve of the by-pass circuit

8. A hydraulic unit in accordance with claim 6, wherein said by-pass circuit comprises a second flow divider connected upstream to an outlet of the sequence valve and downstream to the piloted check valves of the by-pass circuit.

9. A hydraulic unit in accordance with claim 8, wherein said second flow divider has a nominal flow that is greater than said nominal flow of the flow divider.

10. A hydraulic unit in accordance with claim 1, wherein the nominal flow of the flow divider is less than one-fourth of the nominal flow of the control device.

11. A hydraulic unit in accordance with claim 1, wherein the nominal flow of the flow divider is between 6% and 15% of the nominal flow of the control device.

12. A hydraulic unit in accordance with claim 1, wherein a piloted check valve is inserted on a fluid delivery side of each cylinder, said piloted check valve discharging fluid on the fluid delivery side during gripping when a pressure level of the discharge side during gripping of the cylinders exceeds a predetermined threshold.

13. A hydraulic unit in accordance with claim 1, wherein said control device comprises a maximum valve connected in parallel to the pressurized fluid source to control the tightening force on the load.

14. A hydraulic unit in accordance with claim 1, wherein the supply circuit supplies fluid to driving cylinders of the striker arm.

15. A gripping device, comprising:

a plurality of gripping arms;

hydraulic cylinders;

a hydraulic grip control unit a hydraulic fluid source under pressure, said hydraulic grip control unit being connected hydraulically between said hydraulic fluid source under pressure and said hydraulic cylinders to form a closed supply circuit, each of said hydraulic cylinders driving one of said gripping arms, wherein said source feeds fluid to the cylinders, said cylinders being connected hydraulically in parallel, said hydraulic grip control unit including a flow divider connected along said supply circuit between said source and said cylinders such that said flow divider proportionally divides the flow of the circuit between the cylinders in parallel, said flow divider having a nominal flow, said nominal flow of said flow divider being less than a nominal flow of the hydraulic grip control unit, said hydraulic grip control unit including a by-pass circuit connected in parallel to said flow divider, said by-pass circuit having an operative configuration and a non-operative configuration, said fluid flowing through said by-pass circuit and said flow divider in said operative configuration, said fluid not flowing through said by-pass circuit in said non-operative configuration, said hydraulic grip control unit including automatic by-pass circuit piloting means for switching said by-pass circuit to said non-operative configuration when the flow required by the supply circuit is substantially lower than the nominal flow of the flow divider and for switching said by-pass circuit to said operative configuration when said required flow is substantially greater than the nominal flow of the flow divider.

16. A gripping device in accordance with claim 15, wherein said by-pass circuit comprises a second flow divider, a sequence valve and piloted check valves, said second flow divider being connected upstream to an outlet of the sequence valve and downstream to the piloted check valves of the by-pass circuit.

17. A gripping device in accordance with claim 16, wherein said second flow divider has a nominal flow that is greater than said nominal flow of the flow divider.

18. A hydraulic grip unit, comprising:

a hydraulic grip control device;

a striker arm;

a pressurized hydraulic fluid source;

a plurality of hydraulic cylinders;

a plurality of gripping arms driven hydraulically and cooperating with said striker arm for gripping a load, said control device being connected hydraulically between said pressurized hydraulic fluid source and said hydraulic cylinders to define a closed supply circuit, each of said hydraulic cylinders driving one of said gripping arms, wherein said source delivers fluid to at least one of the cylinders, said cylinders being connected hydraulically in parallel, said control device including a flow divider, said flow divider being connected to said supply circuit between said pressurized hydraulic fluid source and said hydraulic cylinders such that said flow divider apportions a fluid flow of the supply circuit between the cylinders in parallel, said flow divider having a flow divider nominal flow, said flow divider nominal flow being less than a control device nominal flow of said control device, said control device including a by-pass circuit connected in parallel to said flow divider, said control device comprising automatic by-pass circuit switching means for switching said by-pass circuit to a blocking fluid position when the flow required by the supply circuit is substantially lower than the nominal flow of the flow divider and for switching said by-pass circuit to a fluid flow position when the flow required by said supply circuit is substantially greater than the nominal flow of the flow divider, said by-pass circuit being in communication with said flow divider in said fluid flow position such that said fluid flows through said by-pass circuit and said flow divider, said fluid not flowing through said by-pass circuit in said blocked fluid flow position.

19. A gripping device in accordance with claim 18, wherein said by-pass circuit comprises a second flow divider, a sequence valve and piloted check valves, said second flow divider being connected upstream to an outlet of the sequence valve and downstream to the piloted check valves of the by-pass circuit.

20. A hydraulic unit in accordance with claim 19, wherein said second flow divider has a nominal flow that is greater than said nominal flow of the flow divider.

* * * * *